United States Patent [19]

Poirier d'Ange d'Orsay

[11] 4,233,949

[45] Nov. 18, 1980

[54] DEVICE FOR PRODUCING AND DISTRIBUTING HIGH TENSION TO THE SPARK PLUGS OF AN INTERNAL COMBUSTION ENGINE

[75] Inventor: Emmanuel J. Poirier d'Ange d'Orsay, Toulouse, France

[73] Assignee: Societe pour l'Equipement de Vehicules, Issy-les-Moulineaux, France

[21] Appl. No.: 954,319

[22] Filed: Oct. 24, 1978

[30] Foreign Application Priority Data

Oct. 27, 1977 [FR] France ..... 77 32449

[51] Int. Cl.[3] ..... F02D 3/02

[52] U.S. Cl. ..... 123/634; 123/643; 315/209 R

[58] Field of Search ..... 123/148 E, 148 DS, 148 D, 123/148 R, 148 ND; 315/209 R

[56] References Cited

U.S. PATENT DOCUMENTS 3,406,314 10/1968 Parish ..... 315/209 R

FOREIGN PATENT DOCUMENTS 833836 5/1960 United Kingdom .
850383 10/1960 United Kingdom .
932737 7/1963 United Kingdom .
1051725 12/1966 United Kingdom .

*Primary Examiner*—Tony M. Argenbright
*Attorney, Agent, or Firm*—Brisebois & Kruger

[57] ABSTRACT

A high tension generating and distributing device includes a plurality of secondary windings 11, 12, connected to associated ones of the spark plugs of an internal combustion engine, these secondary windings being mounted on a single magnetic frame 1, 2 offering a plurality of flux paths through a low tension primary winding 7 or 8, each of these flux paths being associated with one of the secondary windings 11, 12 and with means, for example in the form of flux gaps 3, 4, 5, 6 or auxiliary windings 213, 214 having associated therewith shunt switches 215, 216, for limiting or cancelling the magnetic flux in some of the flux paths so as to leave one flux path with a higher rate of change of flux than the attenuated rate of change of flux in the other flux paths, thereby selecting the secondary winding associated with the non-attenuated flux path as the one in which the high tension current is to flow. Each secondary winding may be associated with one or more sparking plugs, in which latter case the plugs appropriate to the one secondary winding will be in cylinders whose timing is directly opposed in a four-stroke cycle.

17 Claims, 7 Drawing Figures

DEVICE FOR PRODUCING AND DISTRIBUTING HIGH TENSION TO THE SPARK PLUGS OF AN INTERNAL COMBUSTION ENGINE

It is known that internal combustion engines, such as those which are used for propelling automobile vehicles, generally comprise for each cylinder at least one sparking plug which is supplied for each combustion stroke with a high tension current produced by the secondary winding of an ignition coil. Given that, in the known device, a signal ignition coil is arranged for energising all of the sparking plugs of the engine, it is necessary to use a distributor which receives the H.T. current of the secondary winding of the coil and which distributes said high tension current successively to each plug. This function is, in the conventional manner, carried out by a rotor arm which is rotated by the shaft of the distributor associated with the engine and whose end passes as many fixed contacts as there are plugs to be energised, all these contacts being carried by a cap of insulating material which covers the upper part of the distributor.

In order to improve ignition, it has been proposed to increase the voltage provided at the plug. In order to avoid parasitic tracking of the H.T. current on the interior of the distributor cap which carries the fixed contacts, it has been proposed that the distributor cap should be large in size. This requirement leads to the disadvantage that because the distributor cap is bulkier it must then be more cumbersome and difficult to install in the engine compartment of the automobile vehicle.

It has already been proposed to replace the mechanical distributor mentioned above by a device associating, with each spark plug, the secondary winding of a respective coil whose primary winding is in series with a power transistor serving as a switch. This device involves a cost which is too high for it to be practicable.

It has also been proposed, in our U.S. Pat. application Ser. No. 912.713 to provide a distributor device comprising p sparking plugs associated with n ignition coils, p and n being integers, p being greater than or equal to n, each ignition coil comprising a primary winding and a secondary winding, at least one secondary winding of the ignition coil being associated with each sparking plug of the device, the device being characterised by the fact that each ignition coil is associated with a coil switch mounted in parallel across its terminals, control of the different coil switches being effected successively in a periodic fashion for a constant rotational speed of the engine, a single power switch being mounted in series with the assembly of primary windings of the ignition coil. Such a device makes it possible to avoid the multiplicity of power switches and is in consequence of undeniable practical interest. However, this device requires the use of a number of ignition coils which is comprised between p and p/2, the secondary winding of one coil providing the ignition of either one or two plugs. Furthermore, the ignition coils of the device are independent and comprise thus magnetic circuits which are independent from one another. This multiplicity of independent coils places a limit on the cost reduction which has been obtained by the reduction in the number of power switches necessary.

The present invention aims to provide an improved device for producing and distributing the H.T. supply, making it possible to obtain a further cost reduction by reason of the fact that it uses a single magnetic circuit on which are arranged all the primary and secondary windings necessary for the production and the distribution of the H.T. supply for the sparking plugs. It is clear that this device considerably reduces the weight of magnetic material to be used, since there is only a single magnetic circuit in place of several independent ignition coils. Furthermore, the bulkiness of the device is reduced relative to that of the former devices.

Consequently, the present invention provides a device for the production and distribution of high tension current intended for H.T. supply to the sparking plugs of an internal combustion engine, such device comprising: at least one primary winding; at least one secondary winding; and at least one power switch, each secondary winding supplying high tension current to at least one sparking plug, there being at least as many secondary windings as there are primary windings and at least as many sparking plugs as there are secondary windings; wherein the flux linkage between the primary and secondary windings is provided by means of a single magnetic circuit comprising at least two possible flux paths, each of said flux paths being associated with at least one said primary winding, at least one said secondary winding and at least one means effective to limit or cancel the flux or the flux variation in the said flux path.

In a first embodiment there are at least two primary windings, and the means effective to limit or cancel the flux in a flux path of the single magnetic circuit comprises a number of air gaps the numbers of gaps for the different flux paths being different.

In a second embodiment, the means effective to limit or cancel the flux in the flux paths of the single magnetic circuit comprise at least one auxiliary winding, there being at least as many auxiliary windings as there are secondary windings, each said secondary winding being associated with at least one said auxiliary winding, and each auxiliary winding being capable of being placed in open-circuit or closed-circuit state by a switch.

In the first embodiment, it has advantageously been provided that for each primary inductor winding of the device the magnetic circuit comprises as many associated flux paths as there are primary windings of the device, and one of said associated flux paths comprises half as many gaps as there are gaps in the or each other flux path of the device; the magnetic circuit may be constituted by at least two frames having a common side, a flux gap being provided between said common side and the adjacent side of each of the said at least two frames and there being as many said frames as there are primary windings; in a first variant the primary windings may be connected in parallel between one of the L.T. supply polarities and a respective power switch, means being provided to operate the power switches in succession; in a second variant each primary winding is in closed circuit with a respective coil switch, means being provided for controlling the different coil switches successively and in periodic manner for a constant speed of rotation of the engine, a single power switch being provided in series with all the primary windings.

In the second embodiment, it may advantageously be arranged for the magnetic circuit to be constituted by several frames having a common side, there being as many said frames as there are secondary windings; each frame may comprise, on its sides other than the said common side, a primary winding, a secondary winding and an auxiliary winding; in a first variant the primary windings are connected in parallel between one of the L.T. supply polarities and a respective power switch, means being provided to operate the power switches in succession; according to a second variant, each primary winding is in closed circuit with a respective coil switch, means being provided for controlling the different coil switches successively and in periodic manner for a constant speed of rotation of the engine, a single power switch being mounted in series with all the primary windings. It may also be arranged for a single primary winding to be disposed on the common side of the frames, and for each frame to comprise furthermore on its other sides both a secondary winding and an auxiliary winding; each auxiliary winding may be in closed circuit with a coil switch. In a first mode of construction, the primary winding may be connected on the one hand to one of the L.T. supply polarities by the said associated power switch and on the other hand directly to the other L.T. polarity; in another embodiment there may be as many said power switches as there are primary windings, and the primary winding may have one end connected to one of the L.T. polarities by the power switch with which it is associated, its other end being connected to a common point of the auxiliary windings, that end of each auxiliary winding which is not connected to the said common point being coupled to a switch connecting it to the opposite L.T. polarity. The two embodiments mentioned above may be combined in one device in accordance with the invention.

It may advantageously be arranged that the switches of the auxiliary windings are thyristors whose gates are controlled by a sensor; in known manner, each secondary winding may energise one plug or, in the case of a four-stroke engine, each secondary winding may energise two plugs corresponding to the cylinders which have their cycle timing opposed; the power switch associated with a primary winding is advantageously a "Darlington Pair" arrangement of transistors controlled by a sensor.

In order that the present invention may more readily be understood, there will now be described, by way of purely illustrative and non-limiting example, several embodiments with reference to the accompanying drawings, in which.

Figure 1:
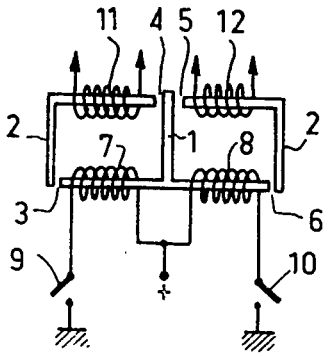
FIGS. 1 to 4 show schematically four different forms of the device according to the invention.

Referring now to FIG. 1, showing one form of the first embodiment of the invention, it can be seen that the H.T. generating and distributing device comprises a single magnetic circuit constituted by the assembly of a T-shaped core member 1 and by two angle core members 2. The circuit thus constituted comprises four flux gaps 3, 4, 5, 6 and it has the overall form of a rectangle bisected by the central stem of the T-shaped core member 1.

Wound on each of the lateral arms of the T-shaped central core member 1 is a respective primary winding 7, 8. One end of each of the windings 7, 8 is connected to the positive polarity of the L.T. supply and the other end is connected to a respective switch 9, 10 which is constituted, in known manner, by a "Darlington" arrangement of transistors (not shown). The switches 9 and 10 thus constitute power switches associated with the two primary windings 7 and 8. Wound on each of the angle core members 2 is a respective secondary winding 11, 12, such that the two ends of each of the secondary windings 11 and 12 are connected to one electrode of a respective one of four spark plugs whose other electrode is connected to ground. This device thus makes it possible to distribute the high tension to the four spark plugs.

The switches 9 and 10 are opened and closed alternately by an ignition control of any conventional type. When the switch 9 is closed the L.T. current builds up in primary winding 7 and, at the moment of opening of the switch 9, it undergoes a rapid current variation which generates a rapid variation in magnetic flux in the magnetic circuit 1, 2.

This magnetic flux can flow along two distinct flux paths; the first crosses the gap 3, follows the angle core member 2, crosses the gap 4 and is completed by the central stem of the T-shaped core member 1; the second flux path crosses the gap 3, follows the angle core member 2, crosses the gaps 4 and 5, follows the second angle 2, crosses the gap 6 and is completed by the transverse arm of the T-shaped core member 1. It can be seen that in the first flux path there are only two gaps 3 and 4, whereas in the second flux path there are four gaps 3, 4, 5, and 6. As a result of the larger number of gaps in the second flux path, there is a considerable attenuation of the flux flowing along the second path, as compared to the flux flowing along the first path. The induced H.T. voltage in the secondary winding 11 upon collapse of this higher flux is thus very considerable whereas the induced H.T. voltage in the other secondary winding 12 where the collapsing flux is attenuated is weak. The spark appears at those plugs which are connected to the secondary winding 11, but does not appear at those plugs which are connected to the secondary winding 12.

This device, which uses the first embodiment of the invention, makes it possible to reduce, with respect to the known devices of similar type, the weight of magnetic material necessary for construction of the magnetic circuits corresponding to the different windings of the device and consequently provides a considerable economy. However the device uses two power switches, and if it is desired to achieve an economy in the number of power switches it will be necessary to adopt an alternative form of the device, shown in FIG. 2.

Figure 2:
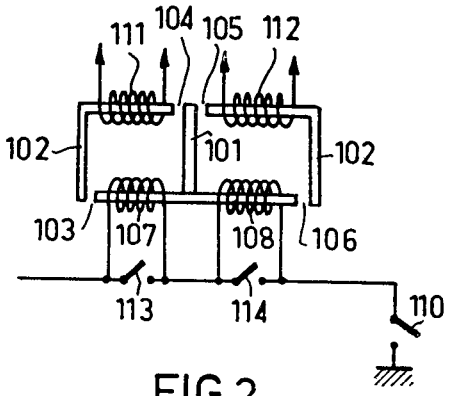

This other method of construction of the first embodiment of the invention, shown in FIG. 2, has the magnetic circuit assembly identical to that adopted for the construction of FIG. 1. This circuit has a T-shaped core member 101 associated with two angle core members 102, and defines four flux gaps 103, 104, 105, 106. The primary windings 107 and 108 and the secondary windings 111 and 112 are disposed exactly as for the construction of FIG. 1, and the two secondary windings 111 and 112 feed four plugs, as for the device of FIG. 1. Across the terminals of each of the primary windings 107 and 108 are disposed switches 113 and 114, respectively, which may be opened or closed in turn. The assembly constituted by the two primary windings is disposed in series with a power switch 110 constituted by a "Darlington Pair" arrangement of transistors. The coil switches 113 and 114 may be in the form of transistors. This type of energisation of the primary windings 107 and 108 has been described in detail for a different device in our said U.S. patent application Ser. No. 912.713.

In operation of the device, the power switch 110 closes to ensure energisation of one primary winding, and opens at a precisely timed instant defined by an ignition controller of conventional type. As the switch 110 opens, one of the switches 113 or 114 will already be open and the other closed; during the cycle following ignition, that one of the switches 113 or 114 which is open at the moment of ignition becomes closed and the other becomes open. If it is assumed that at the moment of ignition the switch 113 is closed then the primary winding 107 is short-circuited and the primary current consequently flows in only the other primary winding 108. Taking account of the difference between the number of flux gaps in the two possible flux paths, as has been explained for the device of FIG. 1, the H.T. voltage induced in the secondary winding 112 by energisation of primary winding 108 will be considerably greater than that induced in the other secondary winding 111 and, consequently, ignition will occur solely on the two plugs which are connected to the "active" secondary winding 112.

It will be noted that this device functions with a single power switch, thus providing an advantage over the device of FIG. 1. It should be noted that the magnetic circuit of the devices of FIGS. 1 and 2 may be of a different form, for example by assembling two C-shaped core elements symmetrically to each side of a rectilinear bar disposed in place of the central stem of the T-shaped core member 101 this providing also two flux gaps in one flux path and four gaps in the other of the two possible flux paths.

Figure 3:
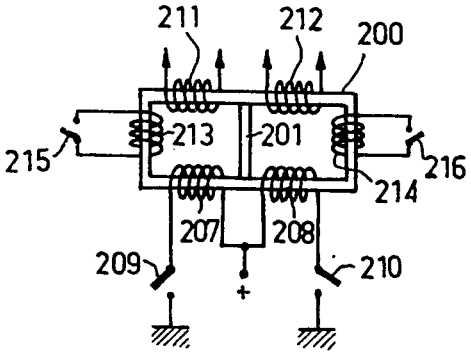

FIG. 3 shows one form of device illustrating the second embodiment of the invention. In this case a magnetic circuit 200 has exactly the same double rectangular form as that shown in FIGS. 1 and 2 but is constituted by a single component, that is to say there are no flux-limiting gaps. The magnetic circuit constitutes thus a simple rectangular frame bisected by a central arm 201. On each of the two thus outer connected frames constituting the magnetic circuit is a respective primary winding 207, 208, a respective secondary winding 211, 212 and a respective auxiliary winding 213, 214. One of the frames comprises the elements 207, 211 and 213, and the other frame comprises the elements 208, 212 and 214. The secondary windings 211, 212 are connected to four spark plugs in the same way as are the secondary windings 11 and 12 of the device of FIG. 1. Across the terminals of the auxiliary windings 213, 214 are disposed respective coil switches 215,216 advantageously in the form of thyristors. When the power switch 210 opens to collapse the primary field, one of the switches 215, 216 will be in the closed state whereas the other will be open, and the configuration of these switches changes between two consecutive ignition instants. The connecting of the primary windings 207 and 208 is identical to the connecting of the primary windings 7 and 8 of the device of FIG. 1, and is achieved by way of two power switches 209 and 210 respectively. As with the device of FIG. 1, the switches 209 and 210 are both "Darlington Pair" transistor switches.

When the switch 210 is in its closed state the switch 215 will also be closed. When the primary current flowing in the primary winding 208 is interrupted by the switch 210 opening, the rapid variation of magnetic flux travels along the frame easily and intersects the secondary winding 212 and the associated auxiliary winding 214 which is in open circuit condition. On the contrary, this rapid flux variation will flow only with difficulty in the other frame half which includes the secondary winding 211 and the other auxiliary winding 213, because the auxiliary winding 213, being short-circuited, opposes the passage of flux created by the primary winding 208 by generating a flux in the opposite sense. It can be seen thus that the presence of the switchable auxiliary winding 213 makes it possible to limit considerably the flux passing in the flux path constituted by the frame half associated with the auxiliary winding 213 by short circuiting that auxiliary winding, while the other auxiliary winding is in open circuit state to present no limitation to the flux path constituted by the corresponding frame half (the one including secondary winding 212).

The alternate closing of the switches 215, 216 thus makes it possible to apply to one or the other of the secondary windings 211, 212 the major part of the flux generated in the magnetic circuit by the energised corresponding primary winding 207 or 208.

It is clear that, in the particular case which has just been described, it would be sufficient to provide a single primary winding and this variant has been shown on FIG. 5 to be described below.

It should moreover be noted that the magnetic circuit of the device of FIG. 3 may, if desired, be provided in a form identical to the magnetic circuit of the devices of FIGS. 1 and 2 by placing appropriately sited flux-limiting gaps in the two magnetic frame halves. In this case it would be necessary to provide two primary windings 207, 208, and the presence of the flux-limiting gaps makes it possible to use simultaneously the flux damping of the gaps (as in the device of FIGS. 1 and 2), and flux damping due to the auxiliary windings (as have just been defined).

It is also possible to arrange for the primary windings 207, 208 and their respective switches to be in series with the respective auxiliary windings 216, 215, each of the two assemblies being connected in parallel to the L.T. supply. This embodiment works as the device of FIG. 4 which will be described below.

Figure 4:
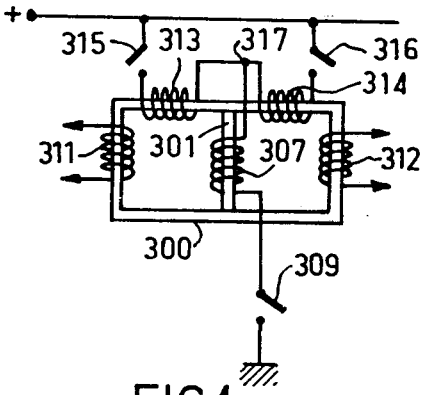

FIG. 4 shows a device which is a variant of the second embodiment of the invention. In this variant, the magnetic circuit 300 is identical to that which has been described for the device of FIG. 3, and is thus constituted by two frames assembled, from a single piece, symmetrically with respect to a central bar 301. On the central bar 301 there is wound a single primary winding 307 of the device. One of the ends of the winding 307 is connected to a power switch 309. On the two frame halves which are symmetrical with respect to the central bar 301, are arranged symmetrically the respective secondary windings 311 and 312 which feed four plugs, as indicated for the device of FIG. 1. Also on the two frame halves are two symmetrical auxiliary windings 313 and 314 each having one of its ends connected to a common point 317. That end of the primary winding 307 which is not connected to the switch 309 is also connected to the common point 317. Those ends of the auxiliary windings 313 and 314 which are not connected to the common point 317 are connected to the respective coil switches 315 and 316 which can connect the windings 313, 314 to the positive H.T. supply. The switch 309 is connected to ground, that is to say to the negative polarity.

The auxiliary windings 313 and 314 each comprise a number of turns which is approximately equal to half the number of turns of the primary winding 307 and these windings 313 and 314 are wound in the sense such that their energisation in series with the primary winding 307 provides in the magnetic circuit a flux in the direction opposite to that which is produced by the primary winding 307.

As the power switch 309 closes, one of the two coil switches 315 and 316 will already be closed, whereas the other is open. Between successive ignition times, the states of the switches 315 and 316 are reversed. Assuming that the switch 316 is closed, then when the switch 309 closes the primary current builds up in the primary winding 307 and one auxiliary winding 314. At the moment of ignition, opening of the switch 309 is triggered by an ignition controller of any conventional type, and this provides thus a magnetic flux generated by the variation of primary current. This magnetic flux has two possible flux paths, namely one constituted by the frame which passes through the auxiliary winding 314 and the other constituted by the frame half which passes through the other auxiliary winding 313. Given that the auxiliary winding 314 provides a flux in the direction opposite to that provided by the primary winding 307, the inducing flux passing through the secondary winding 312 is reduced. On the contrary, no reduction will be undergone by the inducing flux passing through the other secondary winding 311, since the auxiliary winding 313 is in open circuit condition. The ignition spark will thus appear solely on those two plugs which are connected to the secondary winding 311. It will thus be seen that in this way the initial flux along one of the flux paths is limited, not by the inductance of a winding which is in effect in short circuit condition as was the case for the auxiliary in the device of FIG. 3, but by the action of an energising L.T. supply in the auxiliary winding providing an inverse flux. Because the initial flux is reduced it will follow that the flux change upon decay of the L.T. in the primary winding 307 is reduced.

Figure 5:
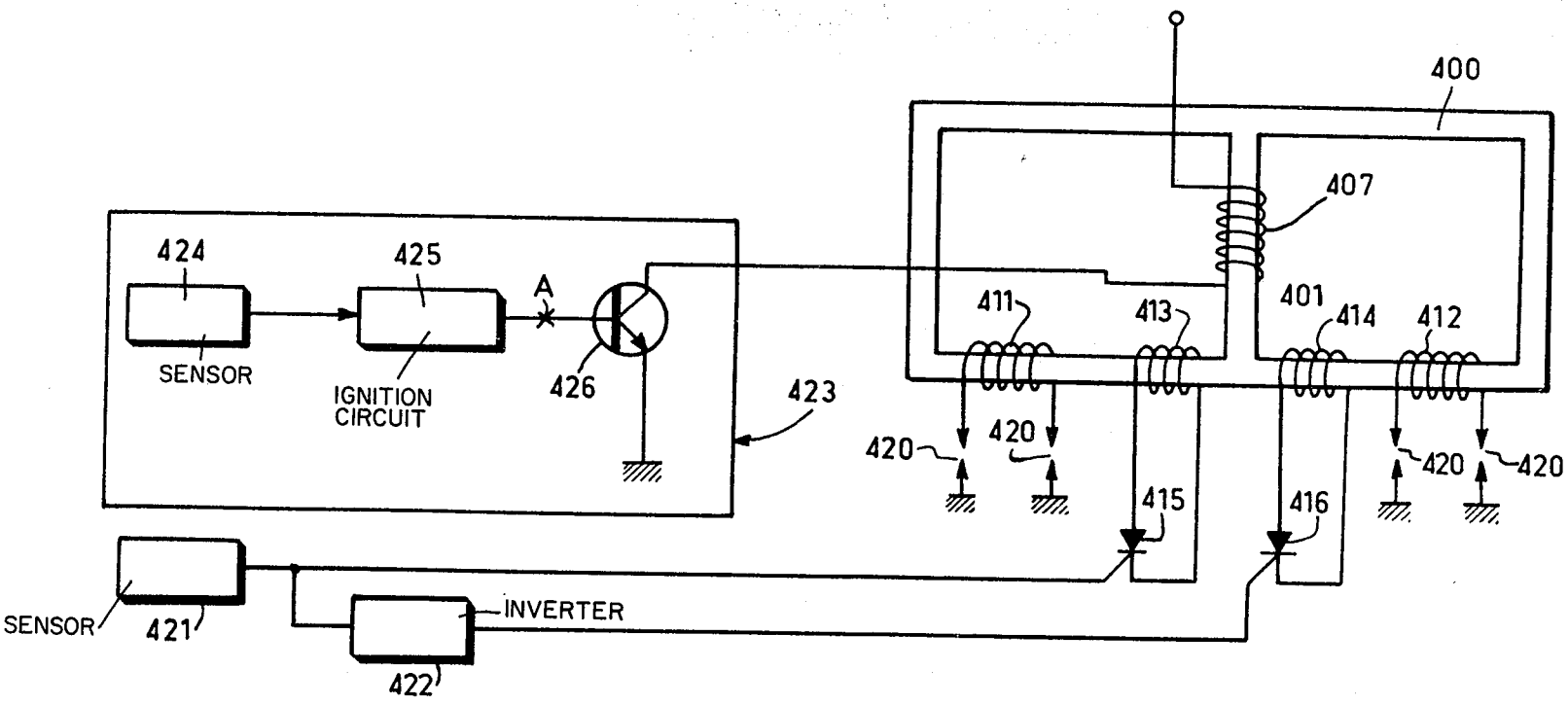
FIG. 5 shows, in more detail, a fifth embodiment of the device according to the invention.

FIG. 5 shows, in detail, a device very similar to that which has been illustrated in FIG. 3. The only difference is that instead of using two primary windings, as was the case for the device of FIG. 3, there is used a single primary winding 407 wound on the central bar 401 of a magnetic circuit 400 in the form of a single member devoid of any flux-limiting gaps. The magnetic circuit 400 is thus constituted by two identical frame halves symmetrical with respect to the central bar 401, and on each of these two frame halves are disposed on the one hand a secondary winding 411, 412 and, on the other hand, an auxiliary winding 413, 414. Each of these secondary windings 411 and 412 is connected to two spark plugs 420. One of the frame halves carries elements 411 and 413, the other frame half carrying the elements 412 and 414. The windings 413 and 414 comprise across their terminals a switch constituted by a respective thyristor 415, 416. The gates of the thyristors 415 and 416 are controlled by a sensor 421 whose pulses pass directly to the thyristor 415 but only after inversion (by means of an inverter 422) to the thyristor 416. The primary winding 407 is energised by means of an ignition control device 423. The control device 423 comprises a sensor 424 whose output signal, responsive to the speed of the vehicle, is applied to an ignition circuit 425 which in turn sends control pulses to an assembly 426 of transistors (for example in "Darlington Pair" arrangement), this transistor assembly 426 constituting the power switch in the primary circuit.

Figure 6:
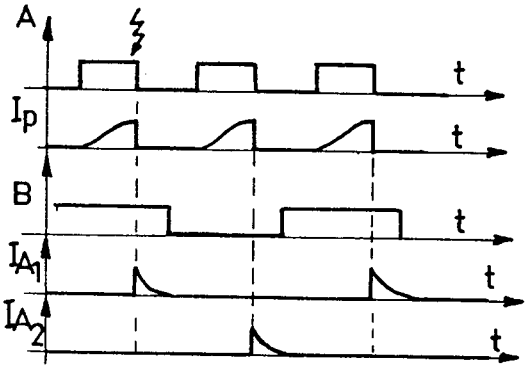
FIG. 6 shows the signals at different points of the circuit of FIG. 5.

FIG. 6 illustrates schematically the current or voltage signals at various points of the circuit which has just been described.

On the base of the transistor switch 426 there are applied square wave pulses represented on the first line of FIG. 6, the rising front of each pulse corresponding to the beginning of the energisation of the primary winding and the decaying front of each pulse corresponding to the instant of ignition.

The second line of FIG. 6 represents the evolution of current in the primary winding 407.

The third line of FIG. 6 represents the signal emitted by the sensor 421 and received, directly, by the gate of thyristor 415 or, after inversion, by the gate of thyristor 413.

The fourth and fifth lines of FIG. 6 represent, respectively, the currents in the auxiliary windings 413 and 414.

It should be noted that the rising front of the square wave pulse signal provided by the sensor 421 (third line of FIG. 6) precedes the decaying front of the signal sent to the power switch 426 (first line of FIG. 6). As a result one or other of the thyristors 415 or 416 is always definitely closed when the power switch 426 is triggered to open. If we assume that, at the moment of opening of the switch 426 it is the thyristor 415 which is conducting, it will be seen that the rapid variation of flux in the primary winding 407 becomes damped by the auxiliary winding 413 which is in short-circuit, but does not become damped by the auxiliary winding 414 which is in open circuit state. As a result the flux is limited on that flux path which is to the left of the central bar 401 on FIG. 5, but is not limited on the other flux path which is to the right of the bar 401 on FIG. 5. The ignition spark is produced only on those plugs 420 which are connected to the secondary winding 412.

It will be seen that in this device, for the ignition of a four cylinder four-stroke engine, there has been only a reduction, with respect to the prior art devices, of the quantity of magnetic material necessary for the magnetic circuit but that there is also a reduction in the quantity of copper necessary for the primary windings.

Figure 7:
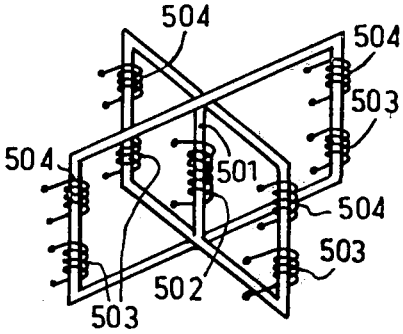
FIG. 7 is a schematic perspective view of a further embodiment of the device according to the invention, corresponding to the embodiment shown in FIG. 5 but adapted to enable distribution over a greater number of spark plugs.

In FIG. 7, there is illustrated schematically an embodiment with which there is associated, around a central bar 501, four magnetic sub-frames which return to the central bar 501 and which each constitute a different flux path. The device comprises a single primary winding 502 and, on each of the sub-frames, a secondary winding 503 and an auxiliary winding 504. Each of the secondary windings 503 is connected to one or two sparking plugs as desired, either to one plug by having one of the ends of the winding connected to ground and the other to a plug, or to two plugs by connecting one of the ends of the secondary winding to one of the electrodes of each of the two plugs with the other electrode of each plug connected to ground. The auxiliary windings 504 have across their terminals a switch (not shown) constituted for example by a thyristor, and the placing into short-circuit or open-circuit state of each secondary winding is controlled by the gating of the thyristors of the corresponding switches. It is thus arranged that at each ignition time, all but one of the auxiliary windings 504 are placed in short-circuit. The device works exactly as that of FIG. 5, and is different in construction only in that it comprises four frames instead of two. It is quite clear that the device may comprise a number of sub-frames greater than four, without the working principle being in any way changed.

In this device of FIG. 7, it is possible for the auxiliary windings 504 to be connected in series with the primary winding 502, as for the device of FIG. 4, and in that case it will be arranged that at each ignition time the switches associated with all but one of the auxiliary windings are closed, the exception being the switch which determines on which sub-frame the magnetic flux is able to flow unattenuated.

It will be understood that the embodiments described above are not in any way limiting, and may be subject to any desirable modifications without thus departing from the scope of the invention as defined by the claims.

I claim:

1. A device for the production and distribution of high tension current supply for the sparking plugs of an internal combustion engine, such device comprising:

(a) primary winding means comprising $q_1$ primary windings where $q_1$ is an integer at least equal to unity;

(b) secondary winding means comprising $q_2$ secondary windings where $q_2$ is an integer not less than two and at least as great as $q_1$;

(c) a low voltage supply to supply low voltge to said primary winding means;

(d) power switch means effective to connect said low voltage supply to and to disconnect said low voltage supply from the primary winding means;

(e) means connecting said secondary winding means to supply H.T. current from each of said secondary windings to a sparking plug of said internal combustion engine, there being at least as many sparking plugs as there are secondary windings;

(f) means providing a flux link between said primary winding means and said secondary winding means, said flux link means comprising a single magnetic circuit including at least two flux path frames having a common side, a secondary winding on a non-common side of each frame; and (g) respective means effective to at least partially suppress the magnetic flux in each of said flux paths, each of said flux paths being associated with at least one said primary winding, and at least one said means effective to at least partially suppress the flux in said flux path.

2. A device according to claim 1, wherein $q_1$ is at least 2 and said means effective to at least partially suppress the flux in each flux path of said single magnetic circuit comprises flux gaps in said possible flux paths such that the number of said flux gaps in one said flux path is less than the number of flux gaps in the remainder of said different flux paths.

3. A device according to claim 2, wherein said single magnetic circuit is so constructed that each said primary winding of the device occurs in $q_1$ associated flux paths, and one of said $q_1$ associated flux paths comprises half as many gaps as there are gaps in the remainder of said different flux paths of the device.

4. A device according to claim 4, wherein said magnetic circuit is constituted by $q_1$ frames having a common side, and means providing a flux gap between said common side and the adjacent side of each of the said at least two frames.

5. A device according to claim 1, wherein said means effective to at least partially suppress the flux in the flux paths of the single magnetic circuit comprise: auxiliary winding means in the form of $q_3$ auxiliary windings, where $q_3 \geqq q_2$ and each said secondary winding is associated with at least one said auxiliary winding; and respective switch means effective to place each said auxiliary winding alternately in open-circuit state and closed-circuit state.

6. A device according to claim 5, wherein said magnetic circuit is constituted by $q_2$ frames having a common side.

7. A device according to claim 6, wherein each frame comprises on its sides other than the said common side, a said primary winding, a said secondary winding, and a said auxiliary winding.

8. A device according to claim 6, wherein said primary winding means comprises a single primary winding disposed on said common side of the frames, and wherein each frame comprises furthermore on its other sides both a said secondary winding and a said auxiliary winding.

9. A device according to claim 8, wherein each primary winding is associated with a respective said power switch means, connecting one end of said primary winding to one of the low voltage supply polarities, and including means connecting the other end of said primary winding directly to the other low voltage polarity.

10. A device according to one of claim 7 or 8, and including a further switch shunting each said auxiliary winding.

11. A device according to claim 8, wherein said power switch means comprises $q_2$ power switches each having one terminal connected to one end of a respective said primary winding and another terminal connected to one of the low voltage supply polarities, and including means connecting the other end of each said primary winding to a common point of the auxiliary windings, a further power switch means connected to the other low voltage supply polarity, and means connecting that end of each auxiliary winding which is not connected to the said common point to said further power switch means.

12. A device according to claim 5, 6, 7, 8, 9 or 11, wherein said switch means effective to place each said auxiliary winding alternately in open-circuit state or closed-circuit state comprises a thyristor and a sensor connected to control the gating of said thyristor.

13. A device according to claim 3, claim 4, or claim 7, wherein said primary windings are connected in parallel between one of the low voltage supply polarities and a respective said power switch means, means being provided to operate said power switch means in succession.

14. A device according to claim 3, claim 4 or claim 7, and including respective coil switch means shunting each primary winding, and means for controlling said coil switch means successively and in periodic manner for a constant speed of rotation of the engine, wherein said power switch means comprise a single power switch mounted in series with all the primary windings.

15. A device according to claim 13 wherein each primary winding is connected in series with the auxiliary winding on the same frame.

16. A device according to one of claim 1, 2, 3, 4, 5, 6, 7, 8, 9 or 11, including means connecting at least one of said secondary windings to a respective single sparking plug of the engine.

17. A device according to any one of claim 1, 2, 3, 4, 5, 6, 7, 8, 9 or 11, when connected to the sparking plugs of a four-stroke internal combustion engine means being provided to connect at least one of said secondary windings being connected to a respective pair of sparking plugs of the engine, wherein the sparking plugs of said respective pair are mounted on cylinders which have their ignition timing directly opposed in the four stroke cycle of said engine.

* * * * *